US005190404A

United States Patent [19]

Kiyokawa et al.

[11] Patent Number: 5,190,404

[45] Date of Patent: Mar. 2, 1993

[54] VERTICAL DRAINAGE DEVICE

[75] Inventors: Nobuo Kiyokawa, Bunkyo; Jun Nishimura, Kuga, both of Japan

[73] Assignees: Mitsui Petrochemical Industrial Products Ltd.; Mitsui Petrochemical Industries, Ltd., both of Tokyo, Japan

[21] Appl. No.: 711,319

[22] Filed: Jun. 6, 1991

[30] Foreign Application Priority Data

Jun. 6, 1990 [JP] Japan ..... 2-59807[U]
May 20, 1991 [JP] Japan ..... 3-35569[U]

[51] Int. Cl.[5] ..... E02B 11/00

[52] U.S. Cl. ..... 405/45; 405/36; 52/169.5

[58] Field of Search ..... 405/36, 43, 45; 210/170, 486; 52/169.5

[56] References Cited

U.S. PATENT DOCUMENTS

| | | | |
|---|---|---|---|
| 3,403,519 | 10/1968 | Balko | 405/45 |
| 3,563,038 | 2/1971 | Healy et al. | 405/45 |
| 3,654,765 | 4/1972 | Healy et al. | 405/45 |
| 3,795,180 | 3/1974 | Larsen | 405/36 |
| 4,622,138 | 11/1986 | Wager | 210/170 |
| 4,704,048 | 11/1987 | Ahlgrimm | 405/45 |

FOREIGN PATENT DOCUMENTS

| | | | |
|---|---|---|---|
| 137516 | 8/1982 | Japan | 405/45 |
| 102311 | 8/1941 | Sweden . | |
| 121887 | 6/1948 | Sweden . | |

*Primary Examiner*—Randolph A. Reese
*Assistant Examiner*—John A. Ricci
*Attorney, Agent, or Firm*—Sherman and Shalloway

[57] ABSTRACT

A vertical drainage device including a generally plate-like elongated conduit member formed of a synthetic resin and a non-woven fabric attached to the conduit member. The vertical drainage device is adapted to be embedded into soil in a vertical direction coincident with a longitudinal direction of the conduit member and adapted to suck up water existing in the soil. The conduit member is comprised of a plurality of parallel vertical ribs extending in the longitudinal direction of the conduit member and a plurality of transverse ribs extending in a transverse direction of the conduit member for connecting the vertical ribs together. A spacing 1 between the adjacent ones of the vertical ribs is set to a 0.5 mm–5 mm, so as to define a conduit space between the adjacent vertical ribs. Accordingly, a drainage efficiency of the vertical drainage device can be greatly improved.

19 Claims, 10 Drawing Sheets

VERTICAL DRAINAGE DEVICE

BACKGROUND OF THE INVENTION

The present invention relates to a vertical drainage device adapted to be embedded in soil such as ground or banking for sucking up water in the soil and draining the soil. More particularly, the present invention relates to a vertical drainage device suitable for improving the ground which can drain the soil such as a weak ground containing a large amount of water up to the surface of the ground.

In recent years, various soil improving methods have been carried out wherein many drainage members each having a non-woven fabric are vertically embedded in the weak ground, so that the water in the ground may be raised through the drainage members up to the surface of the ground. FIG. 12 shows an example of the soil improving methods. Referring to FIG. 12, many drainage members 200 each having a non-woven fabric are vertically embedded in a weak ground 201 so as to be arranged at equal intervals. A drainage layer (e.g., sand mat) 202 is laid on the surface of the weak ground 201. A pore water existing in the weak ground 201 is removed through the drainage members 200 and the drainage layer 202 up to the surface of the weak ground 201, and is then discharged to the outside by a drainage pump 203. A banking 204 is laid on the drainage layer 202, so as to apply a load to the weak ground 201, thereby increasing a water pressure to promote the drainage.

Various forms of such a drainage device are known. For example, the drainage device is constituted of a cylindrical non-woven fabric and an elongated plate-like synthetic resin conduit member disposed in the cylindrical non-woven fabric. Some examples of the synthetic resin conduit member are shown in FIGS. 13 and 14. The conduit member shown in FIG. 13 (which will be hereinafter referred to as B type) is constructed as a thin plate formed with many parallel ribs extending in a longitudinal direction of the plate on opposite sides thereof. On the other hand, the conduit member shown in FIG. 14 (which will be hereinafter referred to as C type) is constructed as a corrugated plate formed of a synthetic resin.

While it is an important subject in designing of such a drainage device to improve a drainage efficiency, the above-mentioned conventional drainage device is not yet satisfactory in the drainage efficiency.

Another conventional drainage device intended to improve the drainage efficiency is disclosed in Japanese Patent Application No. 63-11838 (Japanese Patent Laid-open Publication No. 63-315722) based on British Patent Application Nos. 8701259, 8707545 and 8719584.

The drainage device disclosed in this cited reference is shown in FIGS. 15, 16 and 17. This drainage device comprises a mesh structure formed by a plurality of substantially parallel main strands 12 and a plurality of substantially parallel auxiliary strands 13 connecting the main strands 12 together, and a water permeable member 16 surrounding the mesh structure, wherein an outer surface of the auxiliary strands 13 is flush with one surface of the mesh structure, whereby a main flow passage is defined between the adjacent ones of the main strands 12 so as to extend in parallel to a longitudinal direction of the main strands 12, and an auxiliary flow passage is additionally defined between the adjacent ones of the auxiliary strands 13 so as to extend in parallel to a longitudinal direction of the auxiliary strands 13, and wherein each main strand 12 has a height at least twice a height of each auxiliary strand 13, so that a ratio of a free cross sectional area of each main strand 12 to a free cross sectional area of each auxiliary strand 13 is set to at least 2.5:1.

As shown in FIG. 17, the drainage device is vertically embedded in the soil, and it is connected at its lower end to a conduit 19 which is in turn connected to a sewer 20, thus constructing a drainage system. The water existing in the soil is caught by the drainage device, and is then allowed to fall through the main flow passages each defined between the adjacent main strands 12. Then, the water flows into the conduit 19 to be gathered in the sewer 20. Finally, the water is discharged from the sewer 20 to the outside.

As mentioned above, the drainage device disclosed in Japanese Patent Laid-open Publication No. 63-315722 is constructed so as to allow the water in the soil to fall through the main flow passages defined by the main strands. To increase a water flow in the main flow passages, the height of each main strand is set to at least twice the height of each auxiliary strand, so that the ratio of the free cross sectional area of each main strand to the free cross sectional area of each auxiliary strand is set to at least 2.5:1. Furthermore, a ratio of a spacing of the adjacent main strands to a spacing of the adjacent auxiliary strands is set to from 1.5:1 to 5:1, preferably 2:1. The spacing of the adjacent main strands is typically 8 mm according to the description in this cited reference.

However, the drainage device disclosed in Japanese Patent Laid-open Publication No. 63-315722 is intended to lower the water in the soil through the main flow passages defined by the main strands rather than to raise the water in the soil as by the drainage device of the present invention. Accordingly, although it is considered that the water flow may be increased by setting the spacing between the adjacent main strands to 8 mm in the case of lowering the water through the main flow passages, it has been made apparent from various tests that such spacing of 8 mm is too wide in the case of raising the water in the soil.

SUMMARY OF THE INVENTION

It is accordingly an object of the present invention to provide a vertical drainage device for improving a weak ground which can greatly improve a drainage efficiency.

According to the present invention, there is provided a vertical drainage device including a generally plate-like elongated conduit member formed of a synthetic resin and a non-woven fabric attached to said conduit member, said vertical drainage device being adapted to be embedded into soil in a vertical direction coincident with a longitudinal direction of said conduit member and adapted to suck up water existing in the soil; said conduit member comprising a plurality of parallel vertical ribs extending in the longitudinal direction of said conduit member and a plurality of transverse ribs extending in a transverse direction of said conduit member for connecting said vertical ribs together; wherein a spacing 1 between the adjacent ones of said vertical ribs is set to 0.5 mm–5 mm, so as to define a conduit space between the adjacent vertical ribs.

In operation, when the vertical drainage device is vertically embedded in the soil, water existing in the soil is absorbed by the non-woven fabric. The absorbed water is made into water droplets which are in turn gathered in the conduit space. Thereafter, the water in the conduit space is sucked up to be removed from the soil. Thus, the drainage efficiency is improved.

The transverse ribs may be arranged obliquely with respect to the vertical ribs, and they are mounted on either one side or opposite sides of the vertical ribs.

The conduit member constituting the vertical drainage device is constructed of the parallel vertical ribs extending in the longitudinal direction of the conduit member and the elongated transverse ribs for connecting and retaining the vertical ribs together.

As shown in FIGS. 3 and 4, a thickness (height) h of each of the vertical ribs is set to normally 1 mm–15 mm, preferably 2 mm–5 mm.

A width m of each of vertical ribs is set to normally 0.1 mm–5 mm, preferably 0.5 mm–3 mm.

A spacing l between the adjacent ones of the vertical ribs is set to normally 0.5 mm–5 mm, preferably 1 mm–3 mm.

Accordingly, a cross sectional area of the conduit space is set to normally 0.5 $mm^2$–75 $mm^2$.

On the other hand, a thickness (height) $h_2$ of each of the transverse ribs is set to normally 1 mm–30 mm, preferably 1 mm–3 mm.

A width t of each of the transverse ribs is set to normally 0.1 mm–10 mm, preferably 2 mm–5 mm.

A spacing n of the adjacent ones of the transverse ribs may be set to an appropriate value sufficient to retain the vertical ribs. For instance, the spacing n is set to normally 1 mm–20 mm, preferably 2 mm–10 mm.

Accordingly, a cross sectional area of an elongated space defined between the adjacent ones of the transverse ribs is set to normally 1 $mm^2$–600 $mm^2$.

In the above numerical ranges, the height $h_2$ of each transverse rib is set to preferably ½ or more times the height h of each vertical rib and less than twice the height h. With this construction, the conduit space defined between the adjacent vertical ribs is maintained, and even when the non-woven fabric surrounding the conduit member is forced into the conduit space by a soil pressure, the conduit space is prevented from being blocked by the non-woven fabric.

The transverse ribs are so arranged as to intersect the vertical ribs in either perpendicular or oblique relationship to each other. In the case that the transverse ribs obliquely intersect the vertical ribs, an angle of intersection is set to preferably 20°–70°.

Further, sectional shapes of the transverse ribs and the vertical ribs may be selected from rectangular, circular, semi-circular, and polygonal shapes, for example.

The conduit member is preferably formed of synthetic resin moldings. For example, a material having a sufficient weather resistance such as polyolefin is preferable. Examples of such synthetic resin moldings may include polyolefin such as polyethylene and polypropylene; ethylene-vinyl compound copolymer such as ethylene-vinyl chloride copolymer; styrene resin; vinyl chloride resin such as polyvinyl chloride and polyvinylidene chloride; polyacrylic ester; polyamide; and polyester such as polyethylene terephthalate. These compounds may be solely used or mixed together.

The non-woven fabric constituting the vertical drainage device of the present invention may be selected from various known non-woven fabrics. The kind of the non-woven fabric is generally classified into a wet non-woven fabric whose web has been formed under a wet condition and a dry non-woven fabric whose web has been formed under a dry condition.

The wet non-woven fabric is manufactured by utilizing a paper making process. That is, fiber such as rayon, vinylon, acetate, nylon, acrylic, polyester, polyvinyl chloride, polyolefin, wood pulp, Manila hemp, or any other natural fiber is made into fibril. The fibril is then dispersed in a liquid, and a binder is added to such a dispersion of the fibril. Then, the dispersion containing the binder is subjected to a cylinder paper machine or Fourdrinier paper machine, thus manufacturing the wet non-woven fabric.

On the other hand, the dry non-woven fabric is classified into an adhesive type such that stock filaments are bonded together by adhesive, a mechanical connection type such that filaments are mechanically entangled to be connected together, a spinning type such that spun filaments are collected on a moving collection surface by static electricity or air flow and are connected together, and a heat emboss type such that filaments are partially fused to be connected by heat.

The dry non-woven fabric of the adhesive type is manufactured by a dipping method, printing method, spraying method, powder method, or molten fiber method.

The dry non-woven fabric of the mechanical connection type is manufactured by a needle punch method or stitch method. In the needle punch method, a web is punched by a needle having a barb at an end portion thereof, so that fibers constituting the web are mechanically entangled together by the barb. In the stitch method, webs are connected together by using a thread and utilizing a chain stitch of a sewing machine, for example.

The dry non-woven fabric of the spinning type is manufactured by a short fiber method, long fiber method, or film method. In the short fiber method, air is sprayed to a spun fiber ejected from a spinning nozzle, and short fibers thus obtained are collected on a moving collection surface by static electricity or air flow. This method is also called a sprayed fiber method. In the long fiber method, a long spun fiber ejected from a spinning nozzle is collected on a moving collection surface. This method is typically known as a spun bond method. In the film method, a drawn film is split to become fibril, and the fibril is laminated to obtain a non-woven fabric. This method is also called a split fiber method.

The dry non-woven fabric may be formed of the same synthetic resin as mentioned above for the conduit member, provided that the synthetic resin can be spun to be made into filaments.

The non-woven fabric to be used in the present invention may be selected from the above-mentioned various non-woven fabrics capable of draining the soil. However, as the non-woven fabric is used for the purpose of drainage in the wear ground and the banking, a synthetic resin non-woven fabric having a corrosion resistance is preferable. Especially, a non-woven fabric manufactured by the spun bond method is preferable from the viewpoint of ease of manufacture, and a non-woven fabric formed of polyolefin such as polyethylene or polypropylene is preferable from the viewpoint of a sufficient weather resistance.

Further, a continuous long-fiber non-woven fabric having a bulkiness of 10–200 $g/m^2$, preferably 10–100 $g/m^2$ and having a fineness of 0.5–30 deniers (D), preferably 1-15 D from the viewpoint of water filtration effect.

Further, it is preferable that an elongation of the non-woven fabric is small, so as to prevent the non-woven fabric from being flexed into the conduit space defined between the adjacent vertical ribs by a soil pressure to hinder the water flow in the conduit space. To meet this requirement, it is preferable to use a thin long-fiber non-woven fabric embossed by heat.

DETAILED DESCRIPTION OF THE PREFERRED EMBODIMENTS

Figure 1:
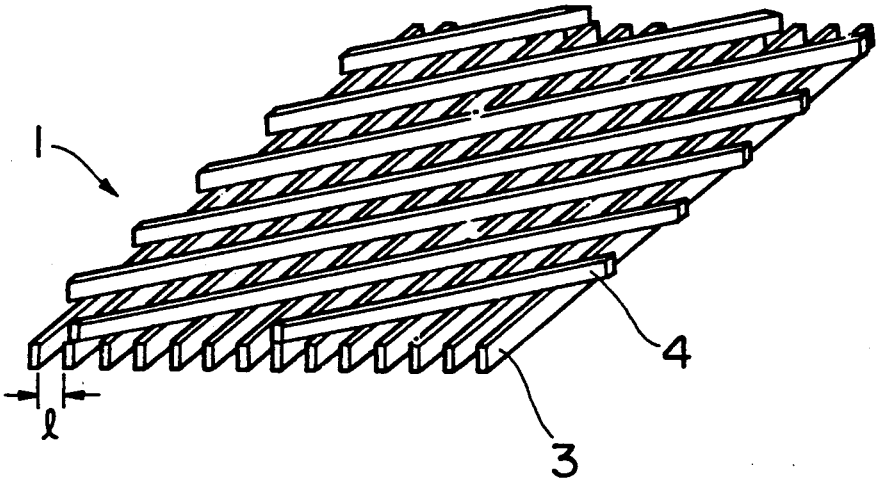
FIG. 1 is a perspective view of one embodiment of the synthetic resin conduit member according to the present invention.

There will now be described some preferred embodiments of the present invention with reference to FIGS. 1 to 11.

FIRST PREFERRED EMBODIMENT

A conduit member 1 formed of a synthetic resin consists of a plurality of (forty-two in this preferred embodiment) vertical ribs 3 and a plurality of (eight in this preferred embodiment) transverse ribs 4 obliquely intersecting the vertical ribs 3 with respect to the longitudinal direction thereof. The vertical ribs 3 and the transverse ribs 4 are integrally connected together.

Each of the vertical ribs 3 has a width m of about 1.0 mm and a height h of about 2.8 mm. Further, the vertical ribs 3 are arranged in parallel at a pitch (center distance) of 2.5 mm and with a spacing 1 of 1.5 mm. Accordingly, a cross sectional area of a conduit space defined between the adjacent ones of the vertical ribs 3 becomes about 4.2 $mm^2$.

On the other hand, each of the transverse ribs 4 has a width t of about 1.0 mm and a height $h_2$ of about 1.9 mm. An angle of intersection of each transverse rib 4 with respect to the longitudinal direction of each vertical rib 3 is set to about 55°.

The transverse ribs 4 are arranged in parallel at a pitch of 12.0 mm and with a spacing n of 11.0 mm. Accordingly, a cross sectional area of an elongated space defined between the adjacent ones of the transverse ribs 4 becomes about 20.9 $mm^2$. Thus, the cross sectional area of the conduit space defined by the adjacent vertical ribs 3 is set to about 0.20 times the cross sectional area of the elongated space defined by the adjacent transverse ribs 4.

Figure 2:
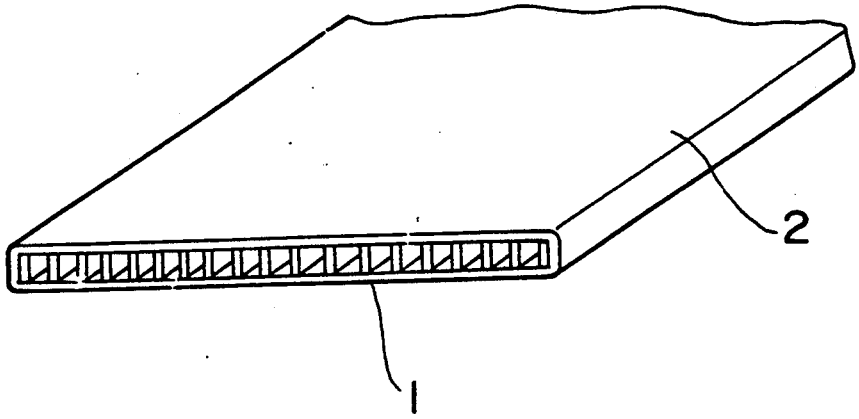
FIG. 2 is a perspective view of the vertical drainage device according to the present invention.
Figure 3:
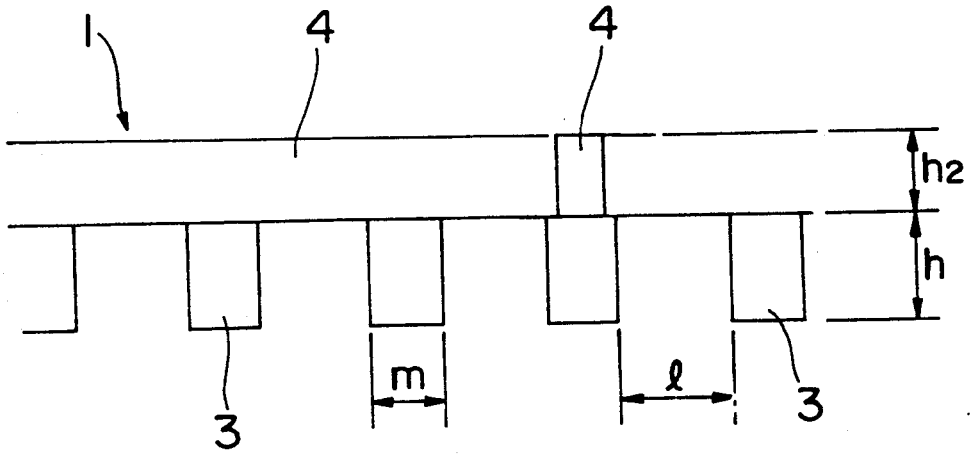
FIG. 3 is a sectional view of the synthetic resin conduit member.
Figure 4:
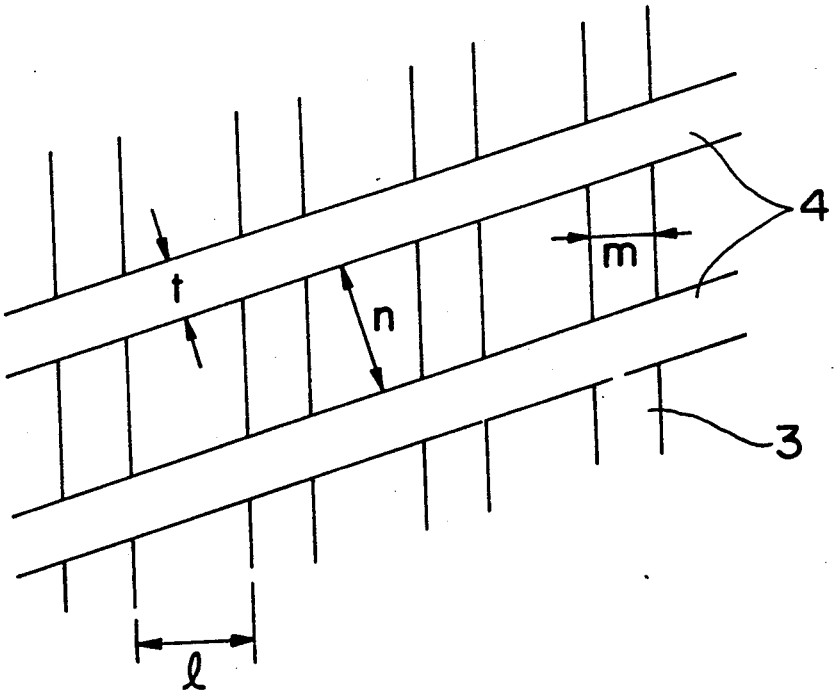
FIG. 4 is a plan view of the synthetic resin conduit member.

The conduit member 1 shown in FIG. 1 is formed of high-density polyethylene. As shown in FIG. 2, a non-woven fabric 2 manufactured by a spun bond method and formed of polypropylene is wound around the conduit member 1.

The non-woven fabric 2 has a bulkiness of 90 $g/m^2$ and a fineness of 4 D, and it is embossed by heat.

Figure 8:
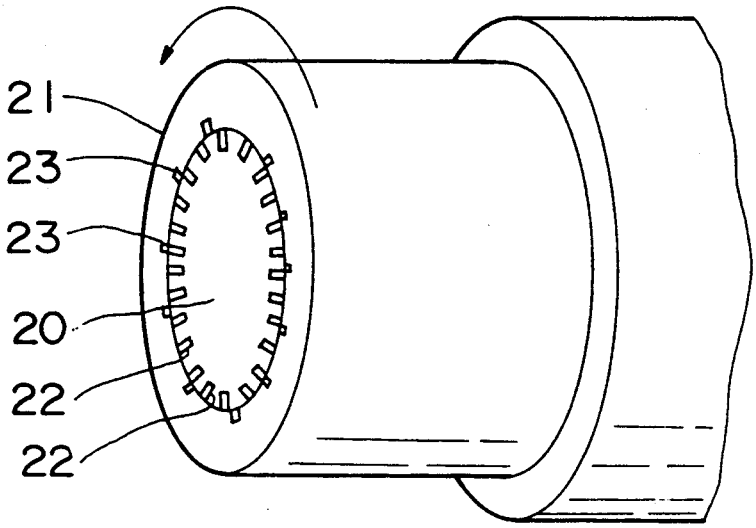
FIG. 8 is a perspective view of a manufacturing device for the conduit member.

A manufacturing method for the conduit member 1 will now be described with reference to FIG. 8. FIG. 8 shows a part of an extrusion molding machine including a columnar fixed die 20 and a cylindrical rotary die 21 rotatably mounted on the outer circumferential surface of the fixed die 20.

The outer circumferential surface of the fixed die 20 is formed with a plurality of nozzles 22 for extruding the vertical ribs 3, while the inner circumferential surface of the rotary die 21 is formed with a plurality of nozzles 23 for extruding the oblique transverse ribs 4.

The nozzles 22 of the fixed die 20 and the nozzles 23 of the rotary die 21 are connected at their respective base ends to a pressure device (not shown) for pressurizing a molten resin.

Simultaneously with pressurizing of the molten resin from the pressure device, the rotary die 21 is rotated to extrude the molten resin, thereby straight forming the vertical ribs 3 from the nozzles 22 and also spirally forming the oblique transverse ribs 4 from the nozzles 23.

When a rotational position of each nozzle 23 becomes coincident with a fixed position of each nozzle 22, both the nozzles 23 and 22 are brought into communication with each other. Accordingly, the vertical ribs 3 and the transverse ribs 4 are integrally connected together at each intersection therebetween, and the manufacture of the conduit member 1 can be made continuous.

After the manufacture of the conduit member 1, the non-woven fabric 2 is wound around the conduit member 1, and is fixed thereto by means of a fastener (staple).

A fixing means for the non-woven fabric 2 is not limited to the fastener, but any other bonding means such as adhesive or heat seal may be used.

Figure 9:
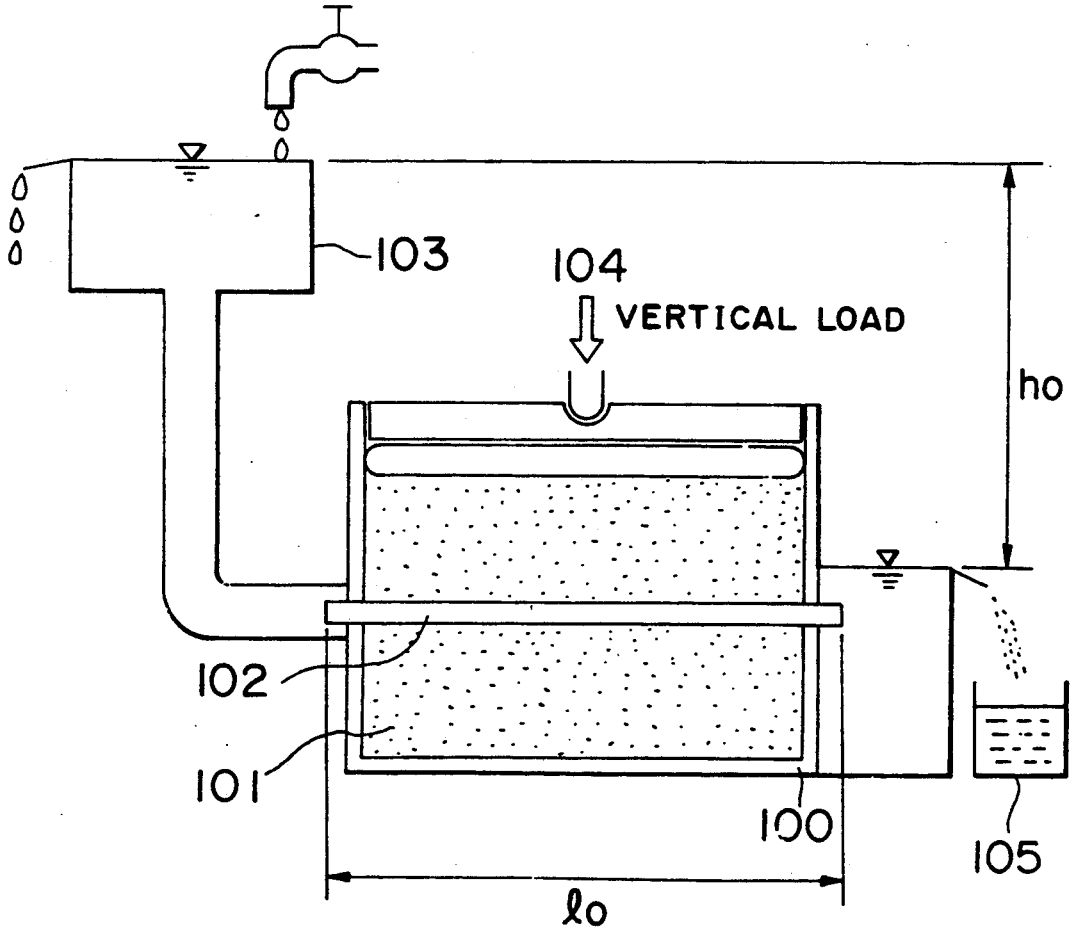
FIG. 9 is a schematic illustration of an experimental device for testing a water flow through the vertical drainage device.
Figure 13:
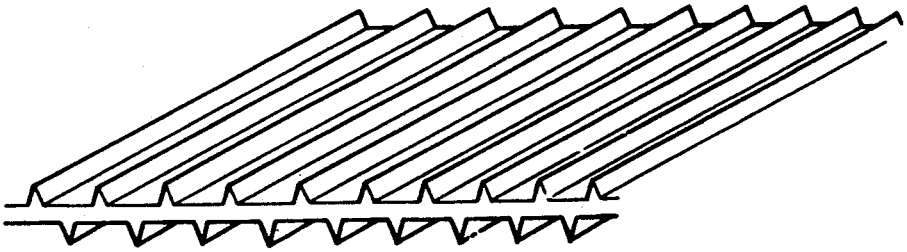
FIG.13 (PRIOR ART)
FIG. 13 is a perspective view of one example of the vertical drainage device in the prior art.
Figure 14:
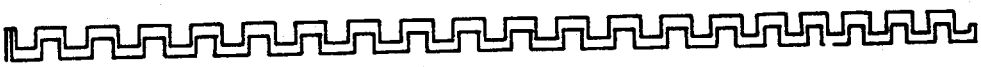
FIG.14 (PRIOR ART)
FIG. 14 is a side view of another example of the vertical drainage device in the prior art.
Figure 15:
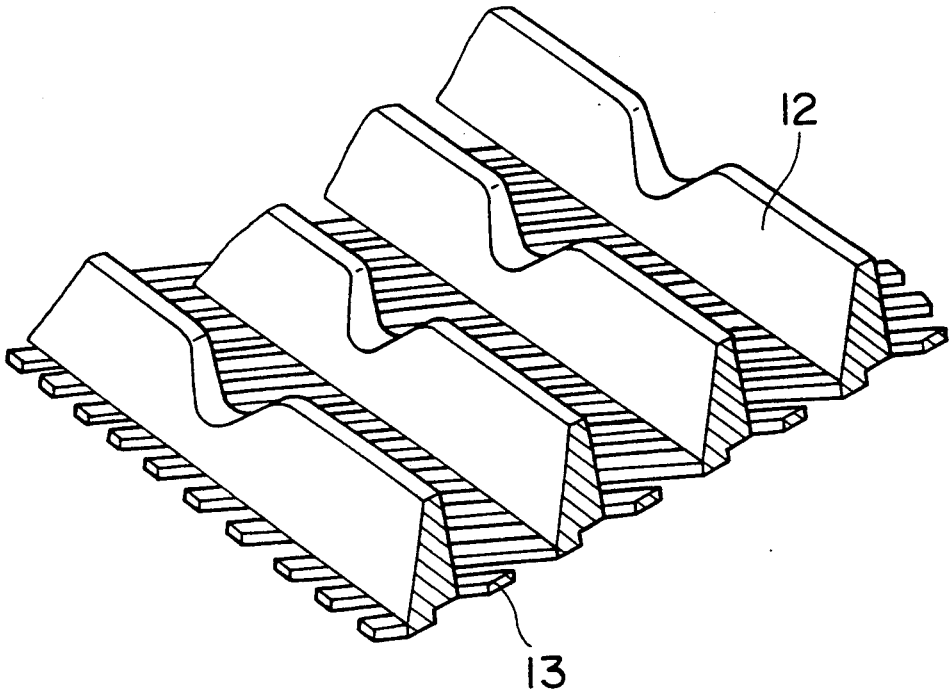
FIG.15 (PRIOR ART)
FIG. 15 is a perspective view of the drainage device disclosed in Japanese Patent Laid-open Publication No. 63-315722.
Figure 16:
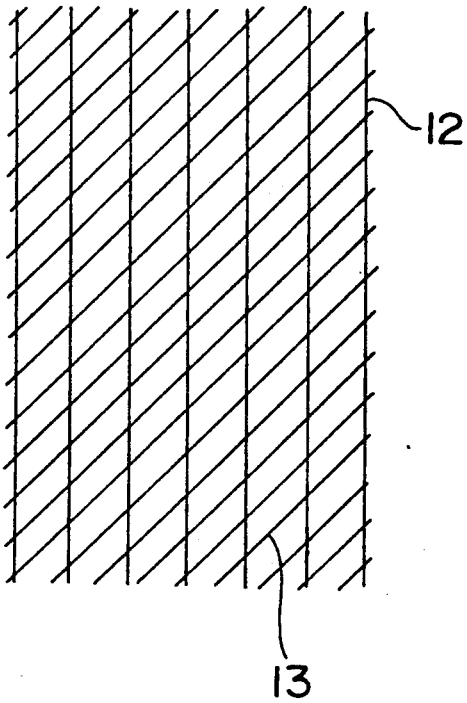
FIG.16 (PRIOR ART)
FIG. 16 is a schematic plan view of the drainage device shown in FIG. 15.
Figure 17:
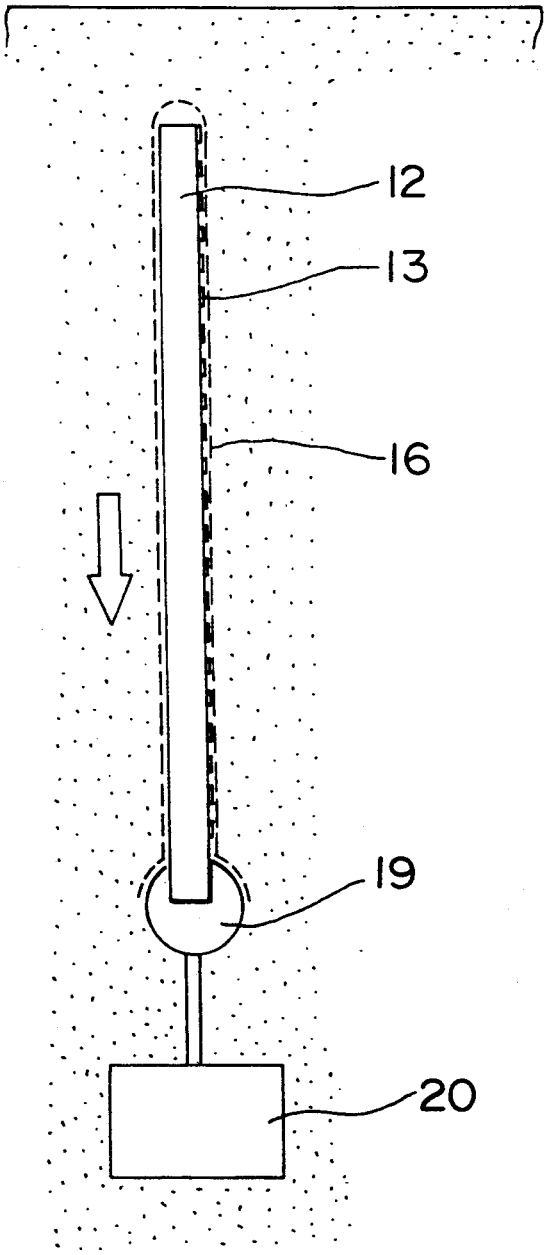
FIG.17 (PRIOR ART)
FIG. 17 is a schematic illustration of an operative condition of the drainage device shown in FIG. 15.
Figure 18:
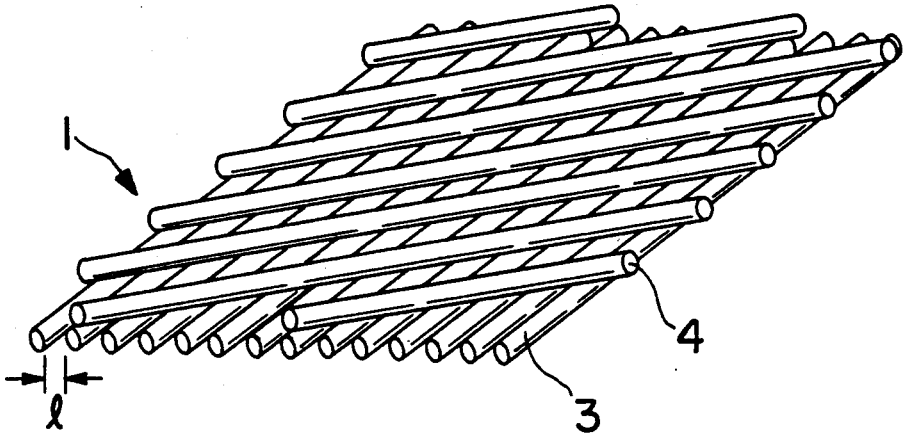
FIG. 18 is a perspective view of another embodiment of the synthetic resin conduit member according to the present invention in which the transverse ribs and the vertical ribs are circular in cross-section.
Figure 19:
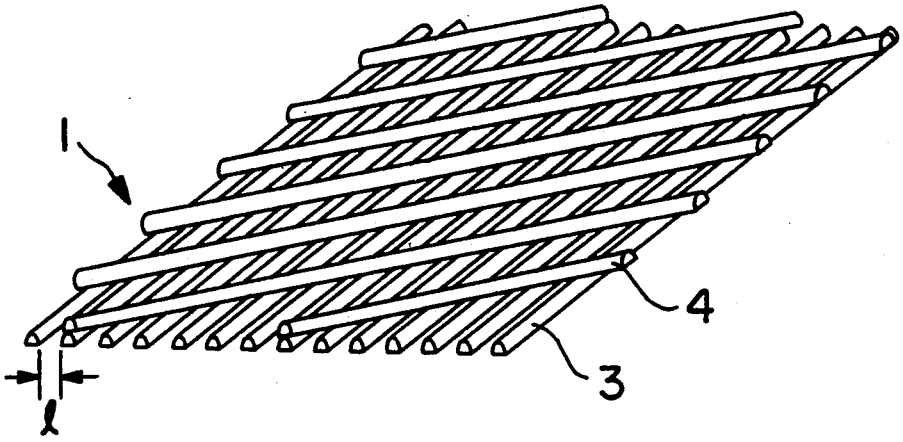
FIG. 19 is a perspective view of still another embodiment of the synetheic resin conduit member according to the present invention in which the transverse ribs and the vertical ribs are semi-circular in cross-section.

The vertical drainage device according to the first preferred embodiment was tested in comparison with the prior art, that is, the B type shown in FIG. 13 and the C type shown in FIG. 14 regarding a water flow through the drainage device, by using an experimental device as shown in FIG. 9.

Referring to FIG. 9, a viscous soil 101 and a test piece 102 of the drainage device are put in a vessel 100, and water is supplied from a water source 103 into the vessel 100. As changing a load 104 to be applied to the viscous soil 101, a water flow Q discharged to a receptacle 105 is measured. The water flow Q is expressed as follows:

$$Q=K\cdot(h_0/l_0)\cdot B_0\cdot T_g$$

where K is a constant; $h_0$ is a head difference; $l_0$ is a length of the test piece; $B_0$ is a width of the test piece; $T_g$ is a thickness of the test piece; and $h_0/l_0$ represents a hydraulic gradient (i). In the test, the hydraulic gradient was changed by changing the head difference $h_0$.

Figure 10:
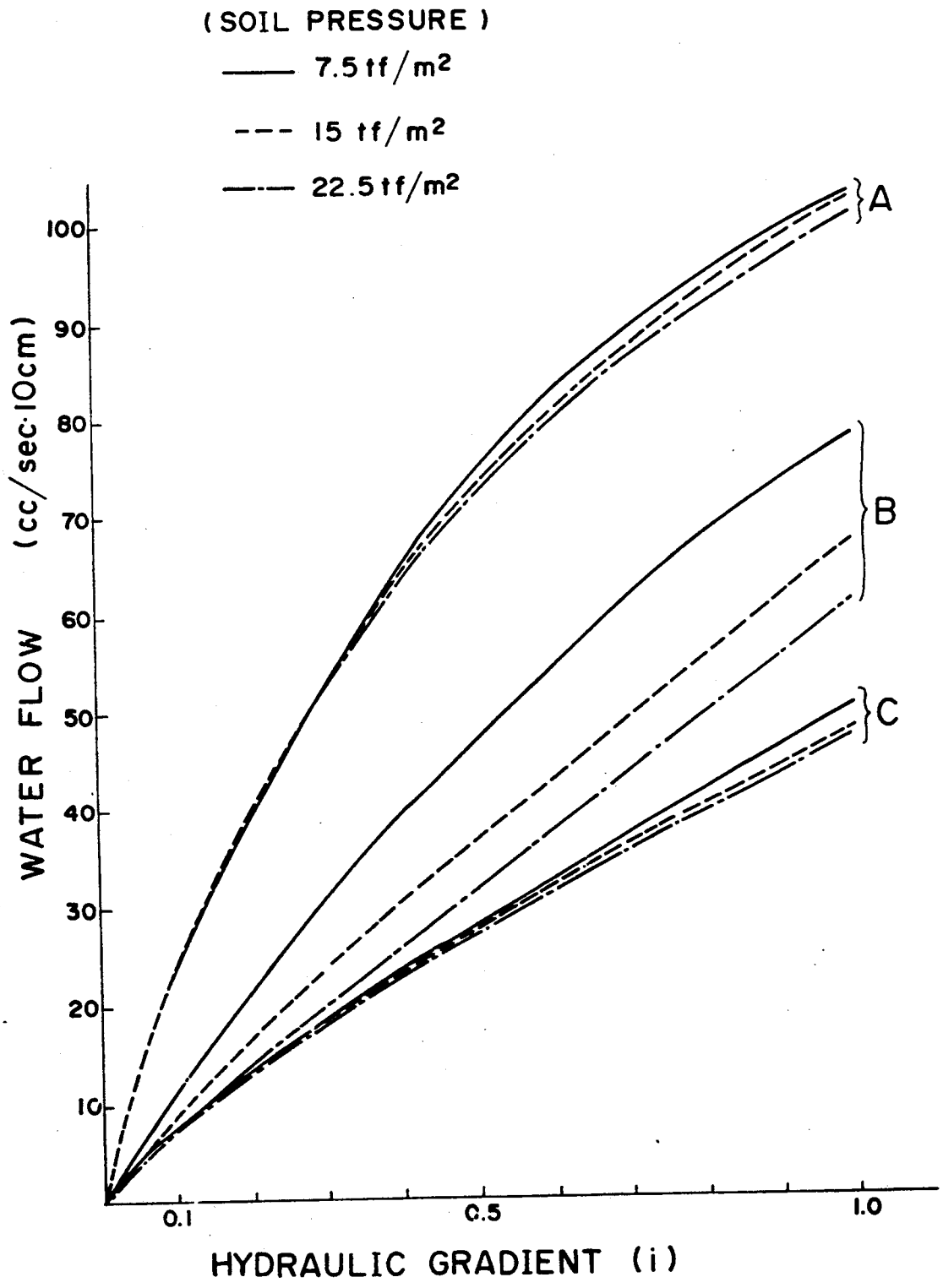
FIG. 10 is a graph illustrating the test results according to the first preferred embodiment and the prior art.

The test results obtained by using the device shown in FIG. 9 are shown in FIG. 10. Referring to FIG. 10, A denotes the test result according to the first preferred embodiment: B denotes the test result according to the B type shown in FIG. 13; and C denotes the test result according to the C type shown in FIG. 14. Further, FIG. 10 shows test results of water flowability under the condition adding the weight pressure. In FIG. 10, solid lines denote the test result under the soil pressure of 7.5 tf/m$^2$; dashed lines denote the test result under the soil pressure of 15 tf/m$^2$; and chain lines denote the test result under the soil pressure of 22.5 tf/m$^2$. Further, in FIG. 10, an axis of abscissa represents the hydraulic gradient i, which means a head loss per unit length of the soil during flowing of the water in the soil.

As apparent from FIG. 10, when the hydraulic gradient is 1.0, the water flow in the first preferred embodiment denoted by the graph A is improved in average by about 50% as compared with the water flow in the B type denoted by the graph B, and is also improved in average by about 100% as compared with the water flow in the C type denoted by the graph C.

SECOND PREFERRED EMBODIMENT

Figure 5:
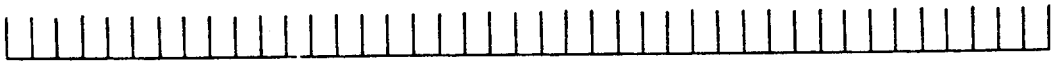
FIG. 5 is a schematic illustration of the vertical ribs of the synthetic resin conduit member according to a first preferred embodiment of the present invention.
Figure 6:
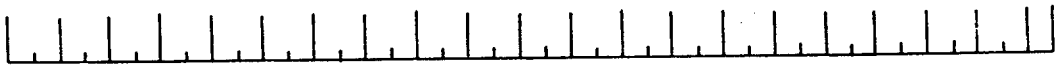
FIG. 6 is a view similar to FIG. 5, showing a second preferred embodiment of the present invention.

As shown in FIG. 6, the vertical drainage device according to the first preferred embodiment shown in FIG. 5 is modified by thinning out the vertical ribs 3 every other one to leave twenty-two ribs 3. As a result, the spacing 1 between the adjacent vertical ribs 3 becomes 4 mm. The same test as the above was carried out. The test result is shown by the graph D in FIG. 11. In the graph D, a solid line denotes the test result under the soil pressure of 7.5 tf/m$^2$; a dashed line denotes the test result under the soil pressure of 15 tf/m$^2$; and a chain line denotes the test result under the soil pressure of 22.5 tf/m$^2$.

Figure 11:
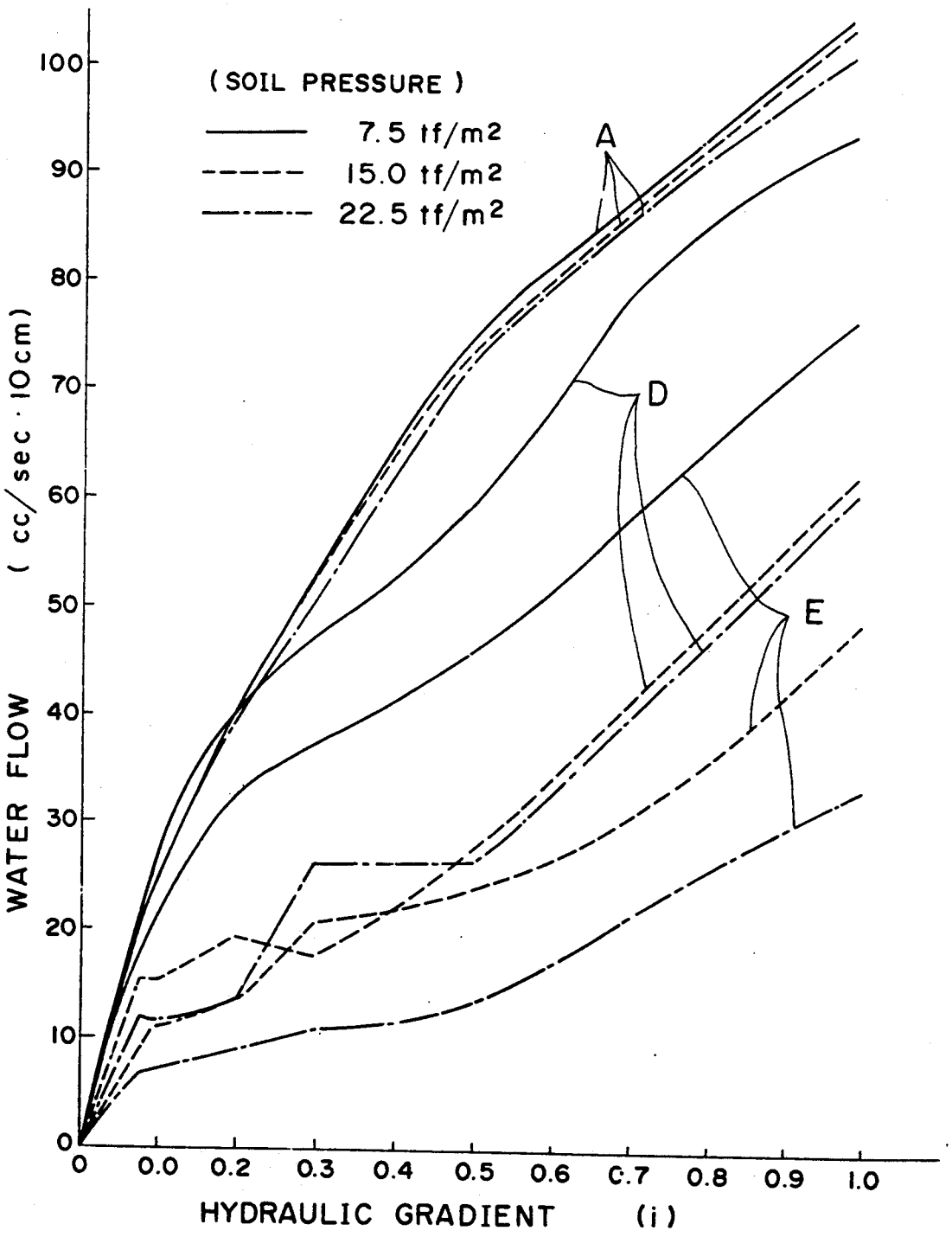
FIG. 11 is a graph illustrating the test results according to the second preferred embodiment and the comparison.
Figure 12:
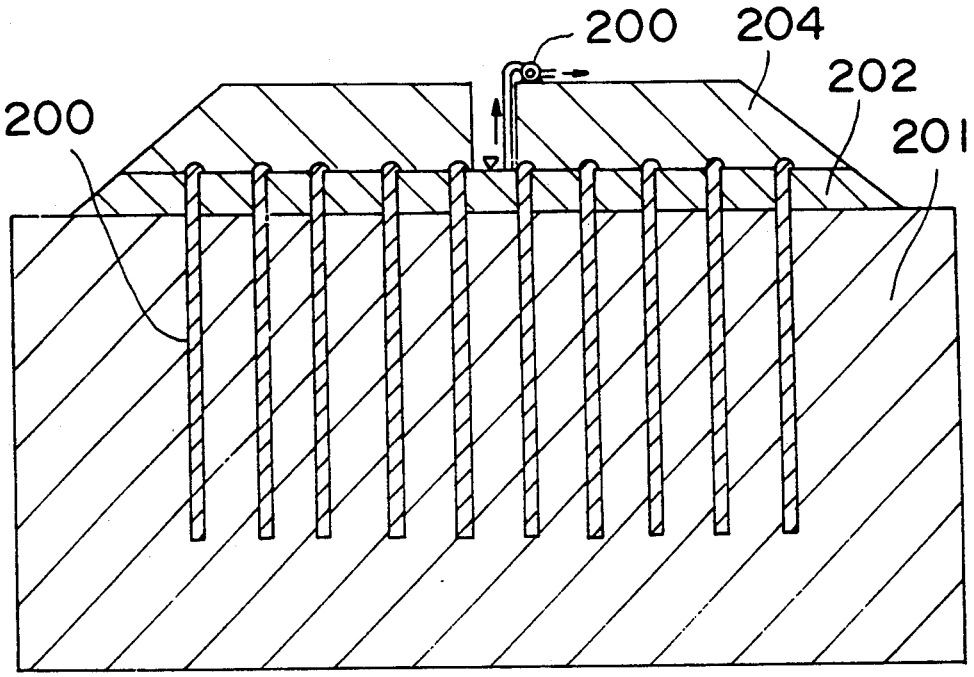
FIG. 12 is a vertical sectional view illustrating an operative condition of the vertical drainage device in the prior art.

As apparent from FIG. 11, the test result under the soil pressure of 7.5 tf/m$^2$ is satisfactory, but the test results under the soil pressure of 15.0 tf/m$^2$ and under the soil pressure of 22.5 tf/m$^2$ are similar to those in the B type.

COMPARISON

Figure 7:
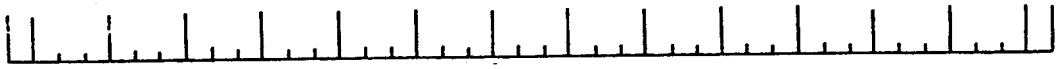
FIG. 7 is a view similar to FIG. 5, showing a comparison.

As a comparison shown in FIG. 7, the vertical drainage device according to the first preferred embodiment shown in FIG. 5 is modified by thinning out the vertical ribs 3 two by two to leave sixteen ribs 3. As a result, the spacing 1 between the adjacent vertical ribs 3 becomes 6.5 mm. The same test as the above was carried out. The test result is shown by the graph E in FIG. 11. In the graph E, a solid line denotes the test result under the soil pressure of 7.5 tf/m$^2$; a dashed line denotes the test result under the soil pressure of 15.0 tf/m$^2$; and a chain line denotes the test result under the soil pressure of 22.5 tf/m$^2$.

As apparent from FIG. 11, the test results under all the soil pressures of 7.5 tf/m$^2$, 15.0 tf/m$^2$ and 22.5 tf/m$^2$ are similar to or inferior to those in the B type.

It is appreciated from the above results that even if the drainage device disclosed in Japanese Patent Laid-open Publication NO. 63-315722 wherein the spacing between the adjacent main strands is 8 mm is applied to the present invention, a sufficient water rising effect cannot be exhibited.

Further, it has been found that a better result would be obtained as compared with the prior art when the spacing 1 between the adjacent vertical ribs 3 is 5 mm or less as compared with the prior art.

In addition, when the height $h_2$ of each transverse rib 4 is set to ½ or more times the height h of each vertical rib 3 and less than twice the height h, there is no possiblity of the conduit space being blocked by the non-woven fabric forced into the conduit space without decreasing the conduit space.

What is claimed is:

1. A vertical drainage device including a generally plate-like elongated conduit member formed of a synthetic resin and a non-woven fabric attached to said conduit member, said vertical drainage device being adapted to be embedded into soil in a vertical direction coincident with a longitudinal direction of said conduit member and adapted to suck up water existing in the soil;

said conduit member comprising a plurality of parallel vertical ribs extending in the longitudinal direction of said conduit member and a plurality of transverse ribs extending in a transverse direction of said conduit member for connecting said vertical ribs together;

wherein a spacing 1 between the adjacent ones of said vertical ribs is set to 0.5 mm–5 mm, so as to define a conduit space between the adjacent vertical ribs.

2. The vertical drainage device as defined in claim 1, wherein said spacing 1 is set to 1 mm–3 mm.

3. The vertical drainage device as defined in claim 1, wherein a cross sectional area of said conduit space is set to 0.5 mm$^2$–75 mm$^2$.

4. The vertical drainage device as defined in claim 1, wherein a thickness (height) h of each of said vertical ribs is set to 1 mm–15 mm.

5. The vertical drainage device as defined in claim 1, wherein a width m of each of said vertical ribs is set to 0.1 mm–5 mm.

6. The vertical drainage device as defined in claim 1, wherein a thickness (height) $h_2$ of each of said transverse ribs is set to 1 mm–30 mm.

7. The vertical drainage device as defined in claim 1, wherein a width t of each of said transverse ribs is set to 0.1 mm–10 mm.

8. The vertical drainage device as defined in claim 1, wherein a spacing n between the adjacent ones of said transverse ribs is set to 1 mm–20 mm.

9. The vertical drainage device as defined in claim 1, wherein an elongated space is defined between the adjacent ones of said transverse ribs, and a cross sectional area of said elongated space is set to 1 $mm^2$–600 $mm^2$.

10. The vertical drainage device as defined in claim 1, wherein said transverse ribs intersect said vertical ribs at an angle of 20°–70°.

11. The vertical drainage device as defined in claim 1, wherein sectional shapes of said vertical ribs and said transverse ribs are selected from rectangular, circular, semicircular, and polygonal shapes.

12. The vertical drainage device as defined in claim 1, wherein said non-woven fabric is formed of polyolefin, and is manufactured by a spun bond method.

13. The vertical drainage device as defined in claim 1, wherein said non-woven fabric is a continuous long-fiber non-woven fabric having a bulkiness of 10–200 $g/m^2$ and a fineness of 0.5–30 deniers (D).

14. The vertical drainage device as defined in claim 1, wherein said non-woven fabric is an embossed long-fiber non-woven fabric.

15. The vertical drainage device as defined in claim 1, wherein a height $h_2$ of each of said transverse ribs is set to ½ or more times a height h of each of said vertical ribs and less than twice said height h.

16. A vertical drainage device including a generally plate-like elongated conduit member formed of a synthetic resin and a non-woven fabric attached to said conduit member, said vertical drainage being adapted to be embedded into soil in a vertical direction coincident with a longitudinal direction of said conduit member and adapted to suck up water existing in the soil;

said conduit member comprising a plurality of parallel vertical ribs extending in the longitudinal direction of said conduit member and a plurality of transverse ribs extending in a transverse direction of said conduit member for connecting said vertical ribs together;

wherein a spacing 1 between the adjacent ones of said vertical ribs is set to 1.0–3 mm, so as to define a condiut space between the adjacent vertical ribs and a height $h_2$ of each of said transverse ribs is set to ½ or less times a height h of each of said vertical ribs and less than twice said height h.

17. The vertical drainage device as defined in claim 16 wherein said transverse ribs intersect said vertical ribs at an angle of 20°–70°.

18. The vertical drainage device as defined in claim 16 wherein sectional shapes of said vertical ribs and said transverse ribs are selected from rectangular, circular, semi-circular, and polygonal shapes.

19. The vertical drainage device as defined in claim 16, wherein said non-woven fabric is formed of polyolefin, and is manufactured by a spun bond method.

* * * * *